United States Patent [19]

Loveland

[11] 3,973,375

[45] Aug. 10, 1976

[54] AUTOMATIC CARTON CLOSING MACHINE EQUIPPED WITH BALANCING TETHER SUSPENSIONS OF THE ELEVATING FLAP-FOLDING AND FLAP-ANCHORING HEAD

[75] Inventor: Winton Loveland, Fort Salonga, N.Y.

[73] Assignee: The Loveshaw Corporation, Deer Park, N.Y.

[22] Filed: Aug. 25, 1975

[21] Appl. No.: 607,093

[52] U.S. Cl. ..... 53/374; 53/75

[51] Int. Cl.[2] ..... B65B 7/20

[58] Field of Search ..... 53/374, 75, 76

[56] References Cited

UNITED STATES PATENTS 3,045,402 7/1962 Keely et al. ..... 53/75

3,267,640 8/1966 Romney et al. ..... 53/75

*Primary Examiner*—Travis S. McGehee

*Attorney, Agent, or Firm*—Watson Leavenworth Kelton & Taggart

[57] ABSTRACT

Elevating flap-folding and flap-anchoring head of automatic carton closing machine is provided with balancing suspension by flexible tether means from support tower or equivalent in any of a variety of ways so that progressively applied forces of operational actions upon top of each carton as it is progressively advanced and closed therebeneath is easily accommodated and offset by such supporting mechanism and reaction thereof.

8 Claims, 3 Drawing Figures

AUTOMATIC CARTON CLOSING MACHINE EQUIPPED WITH BALANCING TETHER SUSPENSIONS OF THE ELEVATING FLAP-FOLDING AND FLAP-ANCHORING HEAD

BACKGROUND AND SUMMARY

The present invention is concerned with maintenance of lateral orientation of the elongated flap-folding and flap-anchoring elevating heads of automatic carton closing machines of the types shown in U.S. Pat. Nos. Re. 26,440 of Aug. 13, 1968 (and its parent 3,236,022) and 3,496,697 of Feb. 24, 1970, during the up and down elevating movement of these heads despite the weight distribution of equipment mounted on them. The base structure of such a machine supports in a revised manner, for the purpose of the present invention, an upstanding tower structure or equivalent which, in turn, is provided for support and lifting and lowering thereon in a new manner such a head without hazarding longitudinal tipping resulting from unbalanced longitudinal distribution of forces. The disclosures of the above-identified U.S. Pat. Nos. Re. 26,440 and 3,496,697 are embodied herein by reference. The carton advancing path of the machine base structure and the tower structure are flanked on opposite sides by similar assemblies of guidance means and flexible tethers of relative allochiral arrangements, and these may be varied in the following manners while attaining the desired advantages and characteristic operations.

Most of such presently new arrangements of tower and tether supports of the flap-folding and flap-anchoring head, and lifting and lowering of the latter as may be required by the differing sizes of loaded cartons being processed therethrough, equip this elevating head on opposite sides with follower means or slides which are free to glide up and down in the opposed upright guide tracks provided by the opposite grooves of the upstanding channel members of the tower structure. In one such arrangement flexible tether means, e.g., a pair of lengths of cable or link chain, are allochirally provided on opposite sides of the elongated elevating head with one end of each anchored to a first portion of the elevator head and preferably by means of the slide mounted to the latter. Each such tether extends down below the elevating head to one of the first pair of guide means (which is on the same side of the lateral carton path of the frame base) and then laps up thereabout as an inverted loop. This flexible tether then extends up above the elevating head back over the one of a second pair of guide means which is also on the same side and finally down as a second loop on this same side to a second portion of the head which is appreciably spaced longitudinally from the first head portion. In this arrangement the first mentioned portion of the elongated elevating head is forward of the flap folding equipment carried thereby with this folding equipment being located in a second head portion that is in a trailing or rearward position. Also, it is preferred that the anchored end runs of the lower inverted and the upper tether loops extend substantially vertically with appreciable lateral distance therebetween, and thus for this purpose the upper loop laps simultaneously over an upper third guide means which is appreciably spaced to the rear of the second guide means.

The tower structure and/or the supporting base structure suitably support power driving means which is connected to the head for lifting and lowering the latter, and the lowering action may comprise chiefly free fall and checking thereof. For example, the top of the tower structure may carry a reversing motor as taught in U.S. Pat. No. 3,496,697 for lifting and lowering the elevating head by suitable driving means such as an endless chain and gearing including driven sprocket means. Also, for this purpose, such a driving motor may drive one or more sprockets meshed with the link chain tether on either or both sides of the machine. It may be preferred that such lifting and lowering of the elevating head be accomplished by operation of a double ended hydraulic motor, apart from such balancing tether suspensions immediately described, and which elevating mechanism is now well-known by virtue of the long use thereof in automatic carton closing machines taught in this U.S. Pat. No. 3,496,697.

It is to be understood that such balancing tether suspensions may be reversed in pattern by anchoring one end of the depending inverted loop at a rearward point on the second or trailing section of the flap-folding and carton-closing elevating head with the upwardly extending run of this loop lapping forwardly over the second and third top guide means finally to extend down to anchorage on the first forward section of the head. The follower means or slide on this same side of the head may be located at the rearward anchorage of the first-mentioned end of the tether, or any other convenient point along the head forward of such location.

Desirable characteristics and advantages of such balancing tether suspensions of the elevating flap-folding head may also be realized by training the flexible length of tether means from the forward point of anchorage directly or vertically down and rearwardly about the lower guide means below the head to extend then obliquely upward and rearwardly to above the head for lap rearward over the second guide means. The remaining end of the tether may then extend directly or vertically down from the rear side of this second uppermost guide means to anchorage on the head at the trailing or rearward point of fixation thereto. The follower means or slide may be mounted to the side of the head at any desired point along its length, e.g., at the forward point of tether anchorage, or the rearward point of such anchorage, or intermediate such points, etc. If desired, the guide means mounted upon the tower structure below and above the elevating head may be so located relative to the laterally spaced points of tether anchorage to the head that the runs thereof are arranged substantially at equal angles to vertical lines passing through the points of anchorage and the centers of the guide means with both of the latter located in the space between the spaced anchorage points. The latter arrangement may tend desirably to brace the lateral elongated head against tendency to rack or teeter, in supplement to the action of the follower means in the vertical tracks, in conditions of unbalancing operational forces.

It is an object of the invention to realize these and other related advantages in economical and reliable manners.

Another object of the invention is to provide such flexible tether guide means in the form of rotary disk means, such as free-running idler pulleys for cable tethers or free-running sprockets for link chain tethers.

Other objects of the invention will in part be obvious and will in part appear from reference to the following detailed description taken in connection with the accompanying drawings, wherein like numerals identify similar parts throughout, and in which.

Figure 1:
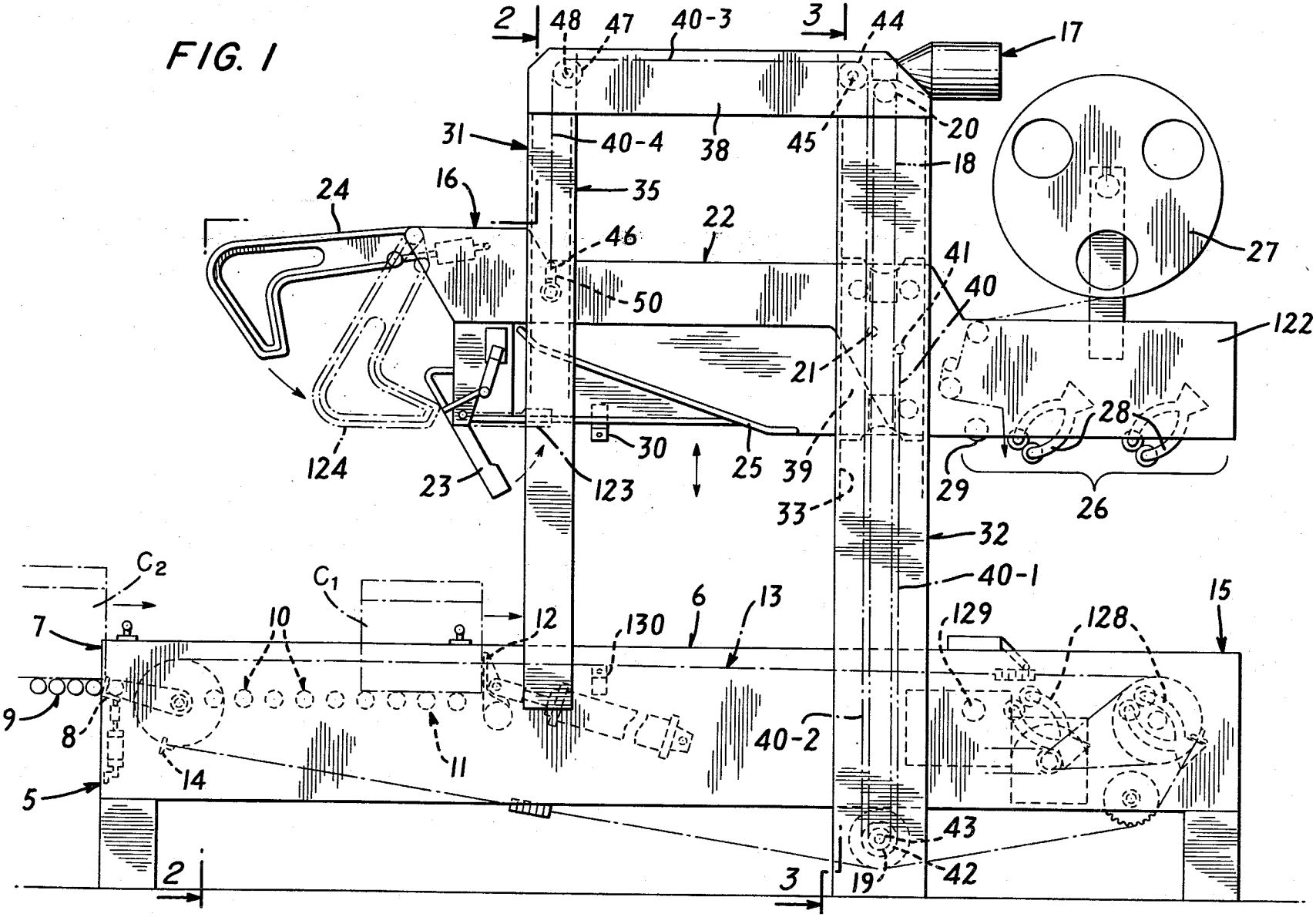
FIG. 1 is a side elevational view to reduced scale, with parts omitted for clarity, of an automatic carton closing machine that embodies means of the present invention which support the elevating flap-folding and flap-anchoring head by balancing tether suspension thereof.

The embodiment of the automatic carton closing machine illustrated by way of example in the drawings comprises a bed unit 5 in the form of a lateral base structure including an elongated rectangular frame 6 which defines a longitudinal lateral path of travel for a series of successive cartons C which are preloaded with contents, but having their top flaps (and, if desired, their bottom closing flaps) unanchored for sealed closure thereof. This base frame 6 has an entrance end 7 periodically blocked by a retractable gate 8 at the delivery end of a feed conveyor 9 which supplies the loaded cartons successively forward onto a lateral lift having a horizontal series of rollers 10 for forward feed to a flap-folding station 11. A fluid-motor operated pivoted gate 12 normally bars the exit from the station 11 for temporary retention of each fed carton $C_1$ thereat. In such stopped position each such loaded carton $C_1$ is located between the side chains of an endless chain conveyor 13 which is temporarily stopped with a cross flight 14 located a distance back of the stopped carton at the flap-folding station 11 behind raised gate 12. When the latter is lowered, following flap-folding operations at this station on this carton the latter is then transported forward by the endless chain conveyor 13 through equipment designed to anchor folded bottom and top flaps and finally out of the discharge end 15 of the machine.

Each supplied carton $C_1$ as it reaches the flap-folding station 11 has its top leading and trailing end flaps and both of its side flaps extending upwardly so that the carton top is open. A flap-folding head 16 is mounted above the flap-folding station 11 so that the open top carton stopped at the latter is located therebeneath for manipulative folding of the upstanding flaps thereby. This head 16 is in the form of an elevating structure which is lifted and lowered by suitable power driven means in properly timed relation by suitable control mechanism. Thus, before the following carton $C_2$, which is checked in a stop position behind the entrance gate 8 is released by lowering of this gate, the flap-folding head 16 will have been suitably lifted high enough to permit this open top carton to be advanced freely to the flap-folding station 11 therebeneath. This lift of the elevating head is accomplished by operation of one of a number of different types of elevator power means well-known in the art, both by virtue of the disclosures of the previously identified prior U.S. Pat. Nos. 3,236,022 and 3,496,697, as well as many of such machines which have long been in commercial service. The latter include machines in which the elevating heads are lifted and lowered by double-ended hydraulic motors. For example, the type of reversing motor and endless chain drive illustrated in these prior art patents includes such motor as is diagrammatically indicated in FIG. 1 at 17 to rotate alternately in opposite directions an endless drive chain 18, or the like, with the runs thereof extending substantially vertically from a bottom sprocket 19 to top sprocket 20 about which it is lapped, and with this endless chain suitably anchored to the elevating head 16, such as at 21.

The elevating head 16 constitutes an elongated, generally lateral beam structure 22 on which is mounted the variety of types of flap-folding equipment and folded flap anchoring means. For example, such elevating head beam 22 may pivotally support a hanging arm 23 for folding down the leading upstanding end flap, a pivotable folding arm or "kicker" 24 for folding forward the trailing upstanding end flap and a pair of side plows 25 for folding down the upstanding side flaps; as well as support on its terminal section 26 of equipment for anchoring the folded top end flaps, such as a gummed tape supply reel 27, tape applying wipers 28, and one or more pressure rollers 29. The discharge end section of the base structure preferably will be equipped with similar flap anchoring mechanism to perform like anchorage of the bottom flaps. If such anchorage is to be accomplished by means of suitable adhesive to be interposed between opposing surfaces of folded flaps the elevating head beam will likewise carry suitable adhesive applying means (such as nozzle 30 and supply equipment therefor) and a plurality of sets of pressure rollers to hold the flaps securely in face-to-face contact while the adhesive sets. Shipping regulations for importing and exporting loaded closed cartons currently are requiring that they be provided with a pair of differing supplemental anchorages for the folded end flaps such as staples and gummed tape, or either one of these supplemented by the anchoring adhesive. As a result, the elevating head beam 22 may have to be of considerable longitudinal length to support equipments for applying two such differing types of flap anchoring means, and of appreciable weight and unbalanced distribution thereof to hazard rocking and tipping due to such unbalancing forces and the effects thereof in the rapid operations required of such machines. The elevating head 16 is thus advantageously suspended by flexible tethers upon suitable tower structure 31, with the latter conveniently supported by the machine base 6.

This tower structure 31 preferably is provided with a pair of upright support members 32 and 132, preferably in the form of relatively rigid and elongated channel members having their grooves 33 and 133 arranged in opposed relation with their bottom ends anchored to the machine base structure 6 and their top ends transversely tied together by a cross brace 34. In the preferred form of this tower structure it includes a second pair of upright members 35 and 135 which may also be in the form of relatively rigid and elongated channel members having their grooves 36 and 136 also arranged in opposed relation with their bottom ends anchored to the machine base structure 6 and with their top ends transversely tied together by another cross brace 37. The top ends of the upright channel members 32 and 132, and 35 and 135 are also longitudinally tied together on opposite sides of the machine base 6 by tower members 38 and 138.

Figure 2:
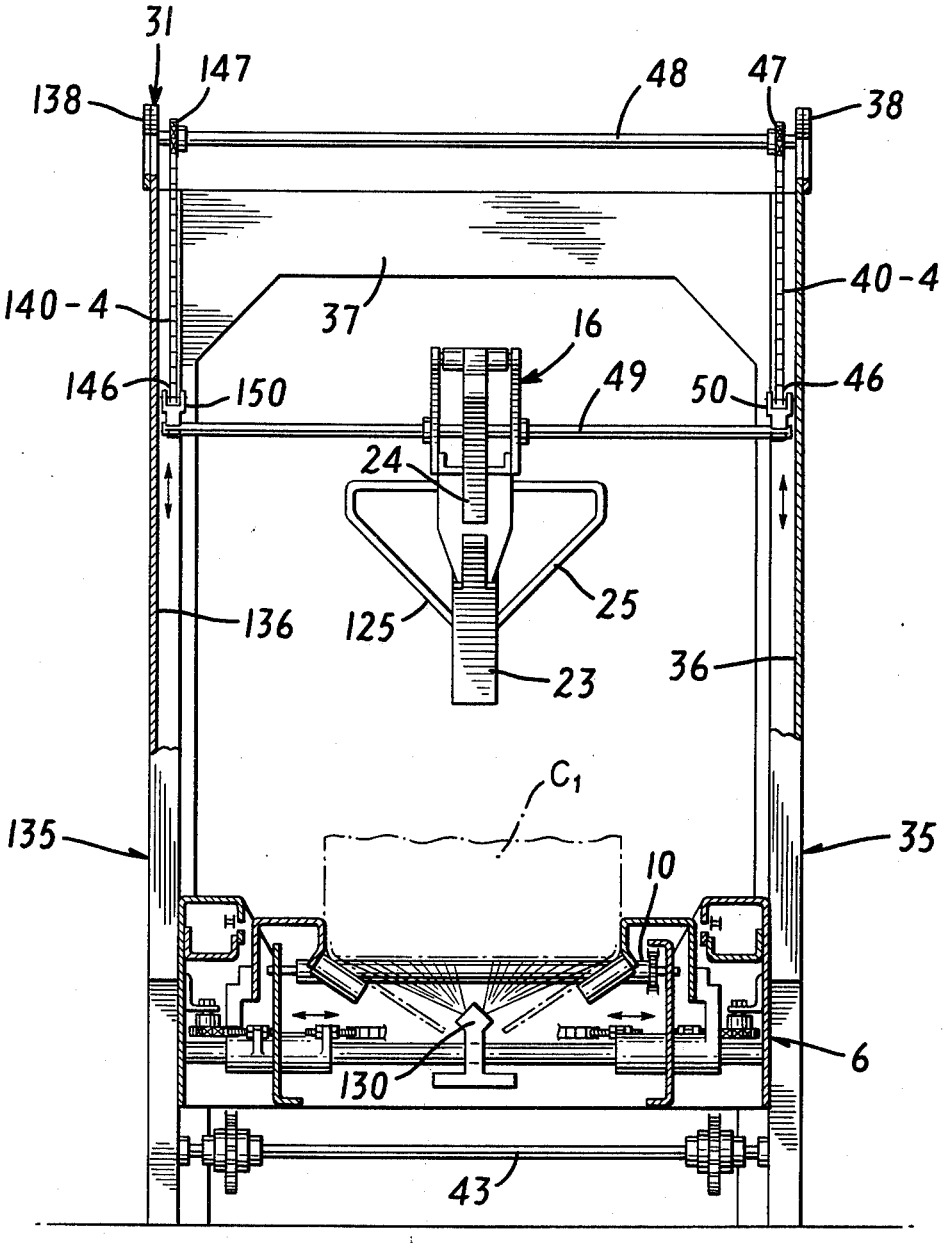
FIG. 2 is a transverse elevational section taken substantially on line 2—2 of FIG. 1.
Figure 3:
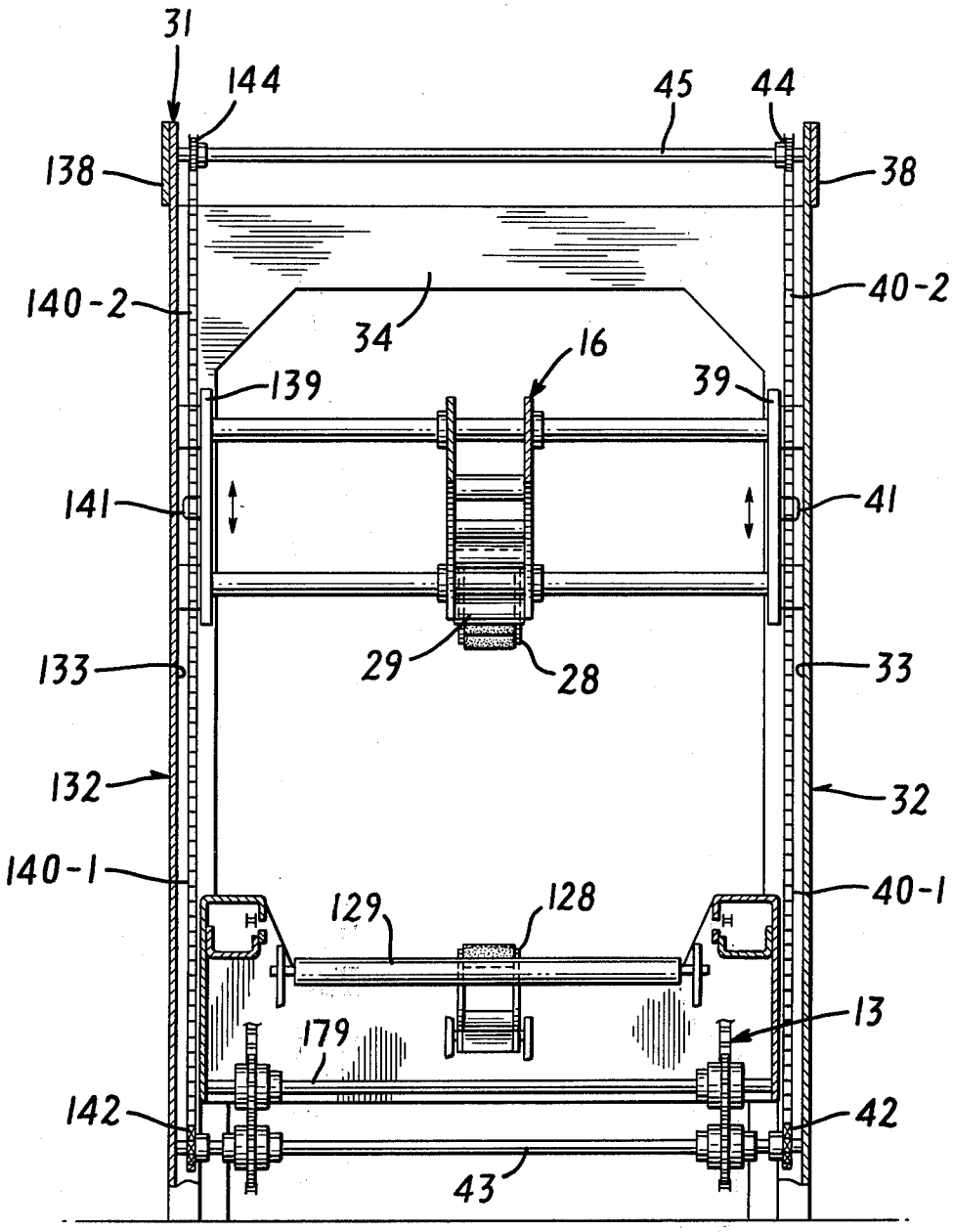
FIG. 3 is a transverse elevational section taken substantially on line 3—3 of FIG. 1.

The elongated head frame or beam 22 preferably is provided on opposite sides with slides 39 and 139 which are capable of slidably traveling up and down within the opposed channel grooves 33 and 133. By fixing these slides to opposite sides of the head beam 22 in a manner to prevent relative rotary movement such slides can, and preferably do, provide some restriction against end-to-end up and down tilting of this beam under conditions of operation. However, when this head beam is greatly elongated and supports weighty equipment at various locations therealong without requiring demanding weight design and placement thereof relative to each other for weight distribution that will avoid longitudinal tilting the solution of such a problem has been found to be simply served by the flexible tether suspension of the present invention. In the preferred form illustrated in the drawings this suspension system consists of two allochirally arranged similar systems on opposite sides of the machine and its tower. For example, that on the near side of the machine as viewed in FIG. 1, and on the right side of FIGS. 2 and 3, includes a flexible tether 40 anchored at 41 to slide plate 39 which in turn glides up and down within the groove 33 of channel 32. The first run 40-1 of this chain link flexible tether extends downwardly to lap underneath and about sprocket 42 which is mounted for free rotation on cross shaft 43 in coaxial relation to free-running sprocket 19 supported thereon. The second run of this chain link flexible tether 40-2 extends upwardly from the opposite side of the sprocket 42 to another free running sprocket 44 mounted upon cross shaft 45 for free running support at the top of the tower 31. This chain link flexible tether then extends forward from the sprocket 44 over which it is lapped to be ultimately anchored down at 46 to the same side of the elevating head 16, but at a rearward section thereof appreciably spaced back from the slide 39. In a preferred pattern of draping of the flexible tether 40 a third run 40-3 extends back toward the approach side of the tower 31 to lap over and down from a third free running sprocket 47 upon a cross shaft 48 which is mounted at the top portions of the other pair of upright channels 35 and 135, so that a fourth and final run 40-4 of this flexible tether extends down to the anchorage 46, which may be a cross shaft 49 extending through the head beam 22 and carrying on its ends anchorage clips 50 and 150.

It will thus be seen that due to the allochiral provision of a similar flexible tether on the opposite side of the machine its tower 31 and the elevating head 16 a pair of flexible tethers 40 and 140 are provided with each having one end anchored to a first portion of the elevator head at 41 and 141 and extending down to and lapped up as an inverted loop about the one of a first pair of guide means 42 and 142 (the first pair of free-running sprockets with location thereof below the elevating head) which is on the same side of the carton path defined longitudinally along the machine base 6. This flexible tether 40, or 140, on the same side then extends up over the one of the second pair of guide means (free-running sprockets 44 and 144) which is on the same side of this carton path and then finally down through runs 40-3 and 40-4, or 140-3 and 140-4, as a second loop on this same side to anchorage at 46, or 146, on the second portion of this elevating head which is appreciably spaced longitudinally from the first head portion anchorage at 41, or 141, whereby lateral orientation of the head is maintained in up and down elevating movement of the latter. It will also be observed that free running sprockets 47 and 147 constitute a third pair of transversely spaced guide means supported by the tower structure above the elevator head 16 and with this pair of sprockets spaced laterally back in the direction of the carton path from the second pair 44 and 144 with each of the second tether loops on opposite sides of the machine being draped down over both of the second and third free-running sprockets on the same sides.

It will also be understood that the free-running sprockets 42 and 142, 44 and 144, and 47 and 147 are in forms of rotary disk means each having its periphery engaged by the tether loop lapped thereabout, which when this tether is a flexible link chain will be such a sprocket and when in the form of a cable will be a pulley. While separate powered mechanism is preferred for lowering and lifting the elevating head it will be appreciated that translation of the vertical run 40-2 of the link chain flexible tether 40 in a vertical direction by being meshed with a driving sprocket will effect the desired lowering of the elevating head 16, with a reversal of the drive of such a driving sprocket effecting the raising; and in this case duplicating such drive on opposite sides of the machine will be more effectively practical. Also such driving translation of the chain link flexible tether may be effected by having such a driving sprocket meshed with the horizontal top run 40-3, preferably for duplication also on the opposite side.

A better understanding of the functioning of such a flexible tether suspension system for the elevating head 16 may be appreciated by recital of the progressive steps of operation of such a machine as a carton $C_1$ is received upon the lift 10 to travel to the flap-folding station 11 and held in a stop position in abutment against the raised gate 12. The automatic controls dictate the lowering operation of the powered mechansim which lifts and lowers the flap-folding head 16, so that the latter descends down toward the top of this stopped carton at the flap-folding station until the pivoted and obliquely depending front flap-folding arm 23 engages the upstanding leading end flap of the carton to cause the latter to swing backward and down upon the load within the carton, as this front flap-folding arm is swung to its broken line position at 123 (FIG. 1). This action also determines the elevation of the head 16 at which it is stopped to be there maintained during the remainder of the operation of the processing of the carton and its delivery from the machine. After so folding back and down the previously upstanding leading end flap with swing upward of the folding arm 23 to its broken line position at 123 the stop gate 12 is swung back to drop down out of the path of this carton for freeing it and allowing the endless chain conveyor 13 to start up and move the carton forward by means of the conveyor flight 14 first to swing the cocked back flap kicker 24 forward to its broken line position 124, so as to fold this upstanding trailing end flap forward, and then as the carton is moving farther forward to allow the side plows 25 and 125 to turn the upstanding side flaps down inward toward each other, over the end folded leading and trailing end flaps. During this action pressure is being applied to the top of the carton by such flap folding operations and the resistance of the carton to such downwardly applied forces will tend to develop upward push to this rearward section or back portion of such elevating head. However, as the closed carton then approaches the forward section or portion 122 of the elevator head beam 22 the anchorage equipment will begin applying downward forces to the top of this same carton as it is being moved forward by the endless conveyor toward the discharge end of the machine so that now upward forces are being applied against this forward section of the head beam to tend to tilt it back in the opposite direction.

The flexible tether suspension system of the present invention adequately accommodates such shifting of applied forces, so as to reduce strain upon the vertical slides which guide the elevator head up and down between columns 32 and 132 and to assure proper operation under the very fast processing of the successive cartons through the machine, without undue strain upon the equipments.

It is to be appreciated that the patterns of draping of the various successive runs of each of the flexible tethers 40 and 140 and their anchorages at opposite ends of the latter (41 and 46, and 141 and 146) to the lateral head beam structure 22 assure that the heavier back section thereof, rearward of the slides 39 and 139 will in its rapid falling and lifting always be suspended in substantially the same lateral position relative to that of the forward section 122 of this head. The suspension tether end runs 40-4 and 140-4 (FIG. 2) apply lift to the cross rod 49 and the other tether end runs 40-1 and 140-1 (FIG. 3) apply substantially equal downward pull to the cross rod 29, whereby downward and upward forces on the rearward and forward head sections are substantially balanced out.

It will thus be seen that the objects set forth above, among those made apparent from the preceding description, are efficiently attained and, since certain changes may be made in the above constructions without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Having described my invention, what I claim as new and desire to secure by Letters Patent is the novel subjects matter defined in the following claims:

1. In an automatic carton closing machine for folding down and inward upwardly extending top flaps of cartons being transported longitudinally therethrough along a lateral path defined by a lateral base structure, the combination with an upwardly and downwardly movable elevator head for effecting the folding of such top flaps when in the vicinity of the top of such a carton and the latter passes forward along the carton lateral path, said elevator head being appreciably elongated longitudinally in the direction of the carton lateral path with support thereby in longitudinal succession of both flap folding equipment and folded flap anchoring equipment to hazard longitudinal tipping resulting from unbalanced longitudinal distribution of forces, of 1. an elevator head-supporting tower structure comprising a plurality of upright members supported by the base structure and located on opposite sides of the carton lateral path, means defining upwardly extending guide tracks on at least some of said tower upright members located to opposite sides of the carton lateral path and movably engageable by follower means carried by said elevator head on opposite sides of said path for up and down motion of said head while constraining its movement in the direction generally parallel to the carton path, said tower and base structures carrying at least a pair of transversely separated flexible-tether guide means located to opposite sides of said carton path below said elevator head and a second pair of such transversely spaced guide means above said elevator head;

2. a pair of flexible tethers each having one end anchored to a first portion of said elevator head and extending down to and lapped up as an inverted loop about the one of said first pair of guide means on the same side of said carton path, then up over the one of said second pair of guide means on the same side of this carton path and finally down as a second loop on the same side of this carton path to anchorage on a second portion of said head appreciably spaced longitudinally from said first head portion whereby lateral orientation of said head is maintained in up and down elevating movement of the latter;

and power driving means connected to said head to lift and lower the latter.

2. The carton closing machine of claim 1 characterized by a third pair of such transversely spaced guide means supported by said tower structure above said elevator head and spaced laterally in the direction of said carton path from said second pair of guide means, said second loop in each tether being draped down over both of the second and third guide means on the same side of the carton path.

3. The carton closing machine of claim 1 characterized by each of said pair of flexible tethers being anchored to the first portion of said elevator head by connection to the follower means carried thereat.

4. The carton closing machine of claim 3 characterized by a third pair of the transversely spaced guide means supported by said tower structure above said elevator head and spaced laterally in the direction of said carton path from said second pair of guide means with each second tether loop being draped down over both of the second and third guide means on the same side.

5. The carton closing machine of claim 4 characterized by each of said guide means being in the form of rotary disk means having its periphery engaged by the tether loop lapped thereabout.

6. The carton closing machine of claim 5 characterized by each of said tethers being in the form of a linked chain with each of said guide disk means being in the form of a sprocket meshed therewith.

7. The carton closing machine of claim 6 characterized by said tower structure including two pairs of upright members with said pairs spaced appreciably along the longitudinal carton path and having their lower portions anchored to said lateral base structure, one pair of said upright tower members being opposed channels which define in opposed relation said guide tracks with said follower means carried by said elevator head sliding up and down therein.

8. The carton closing machine of claim 7 characterized by the other pair of said upright tower members also being opposed channels with said second head portion anchorage being in the form of a cross bar having its ends riding up and down therein.

* * * * *